US006959158B2

(12) United States Patent
Ohta

(10) Patent No.: US 6,959,158 B2
(45) Date of Patent: Oct. 25, 2005

(54) FIXING DEVICE AND IMAGE FORMING APPARATUS

(75) Inventor: Tomoichirou Ohta, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/412,394

(22) Filed: Apr. 14, 2003

(65) Prior Publication Data

US 2004/0037580 A1 Feb. 26, 2004

(30) Foreign Application Priority Data

Apr. 15, 2002 (JP) ..... 2002-111945
Apr. 3, 2003 (JP) ..... 2003-100451

(51) Int. Cl.[7] ..... G03G 15/20
(52) U.S. Cl. ..... 399/69; 219/619; 219/636
(58) Field of Search ..... 399/335, 336, 399/328, 69, 67; 219/636, 619, 469–471, 216

(56) References Cited

U.S. PATENT DOCUMENTS 5,543,904 A * 8/1996 Kato et al. ..... 399/335
5,801,360 A * 9/1998 Oba et al. ..... 219/216
5,942,882 A 8/1999 Ohta ..... 323/282
6,188,054 B1 2/2001 Ohta ..... 219/663
6,519,426 B2 * 2/2003 Goto et al. ..... 399/69
2001/0019670 A1 * 9/2001 Hayashi ..... 399/69

* cited by examiner

*Primary Examiner*—Susan Lee
(74) *Attorney, Agent, or Firm*—Fitzpatrick, Cella Harper & Scinto

(57) ABSTRACT

A fixing device has a magnetic field generator; an electric power supplier for electric power supply to the magnetic field generator; electric power controller for controlling an electric power value to be supplied by the electric power supplier; a fixing member, disposed in the magnetic field, having an electroconductive layer which generates heat by eddy current generated by the magnetic field; a temperature detecting member for detecting a temperature of the fixing member; a discriminator for discriminating whether the apparatus is in order by comparing a detected temperature to a reference temperature in a period from a start of heating the fixing member to arrival at a predetermined temperature; and a reference temperature changer for changing the reference temperature on the basis of the supplied electric power value upon the electric power controller changing the electric power value.

13 Claims, 7 Drawing Sheets

FIXING DEVICE AND IMAGE FORMING APPARATUS

FIELD OF THE INVENTION AND RELATED ART

The present invention relates to a fixing device for heating and fixing of a recording paper (recording material) with heat-fusing powder such as toner using induction heating as a heat generation source. An image forming apparatus comprises image forming means for forming a visualized image (toner image) on a recording material (recording paper) with visualizing material (toner), recording paper feeding means for feeding recording paper on which the toner image is formed and fixing means for heating and fixing the toner image on the recording paper.

Recently, an induction heating type comprising a fixing roller (heating member) 100 and a pressing roller 101 which are press-contacted to each other as shown in FIG. 8 is noted from the standpoint of saving energy consumption. In the induction heating type, the high frequency current is applied to the induction heating coil L1, the generated high frequency magnetic field acts on the electroconductive layer which is an inner surface layer of the fixing roller, by which eddy currents are generated in the electroconductive layer, and the eddy current causes self-heat-generation in the fixing roller 100 by joule heat.

With the induction heating type, the electroconductive layer 100*a* (inner surface layer) of the fixing roller is itself a heat generating element (direct heating), and therefore, the heat generating efficiency is high. This easily accomplished quick heating of the fixing roller 100 to a required fixing temperature, and therefore, quick start-up is possible. In addition, the high efficiency of electric power using can significantly reduce the electric energy consumption.

Such a fixing device of induction heating type is provided with both of a software safety means using CPU or the like as temperature abnormality detecting means, and a hardware safety means such as temperature detection means (mechanical contact) using bimetal or the like or a temperature detecting means using a constant melting point metal which fuses at a predetermined temperature. However, when the fixing roller is rapidly heated as with the said induction heating type, the conventional software safety means is insufficient. The temperature rise of the heating member can be so quick that temperature of the heating member may rise to such a temperature as to cause a mechanical malfunction before the actuation of the hardware temperature detecting means using a mechanical contact for the excessive temperature rise detection, is actuated.

SUMMARY OF THE INVENTION

Accordingly, it is a principal object of the present invention to provide a fixing device wherein the temperature abnormality detection accuracy of induction heating apparatus is enhanced, and an image forming apparatus capable of high quality image formation.

According to an aspect of the present invention, there is provided a fixing device comprising magnetic field generating means for generating a high frequency magnetic field; electric power supplying means for electric power supply to said magnetic field generating means; electric power control means for controlling an electric power value to be supplied by said electric power supplying means; a fixing member, disposed in the magnetic field generated by said magnetic field generating means, having an electroconductive layer which generates heat by eddy currents generated by the magnetic field; a temperature detecting member for detecting a temperature of said fixing member; discriminating means for making discrimination as to whether or not said apparatus is in order by comparing a detected temperature provided by said temperature detecting member a reference temperature in a period from start of heating said fixing member to arrival at a predetermined temperature of said fixing member; and reference temperature changing means for changing the reference temperature on the basis of the supplied electric power value upon said electric power control means changing the electric power value.

According to another aspect of the present invention, there is provided an image forming apparatus comprising image forming means for forming a toner image on a recording material; magnetic field generating means for generating a high frequency magnetic field; electric power supplying means for electric power supply to said magnetic field generating means; electric power control means for controlling an electric power value to be supplied by said electric power supplying means; a fixing member, disposed in the magnetic field generated by said magnetic field generating means, having an electroconductive layer which generates heat by eddy currents generated by the magnetic field; a temperature detecting member for detecting a temperature of said fixing member; and discriminating means for making discrimination as to whether or not said apparatus is in order by comparing a detected temperature provided by said temperature detecting member a reference temperature in a period from start of heating said fixing member to arrival at a predetermined temperature of said fixing member; and reference temperature changing means for changing the reference temperature on the basis of the supplied electric power value upon said electric power control means changing the electric power value.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The description will be made as to the preferred embodiment of the present invention.

Embodiment 1

Figure 1:
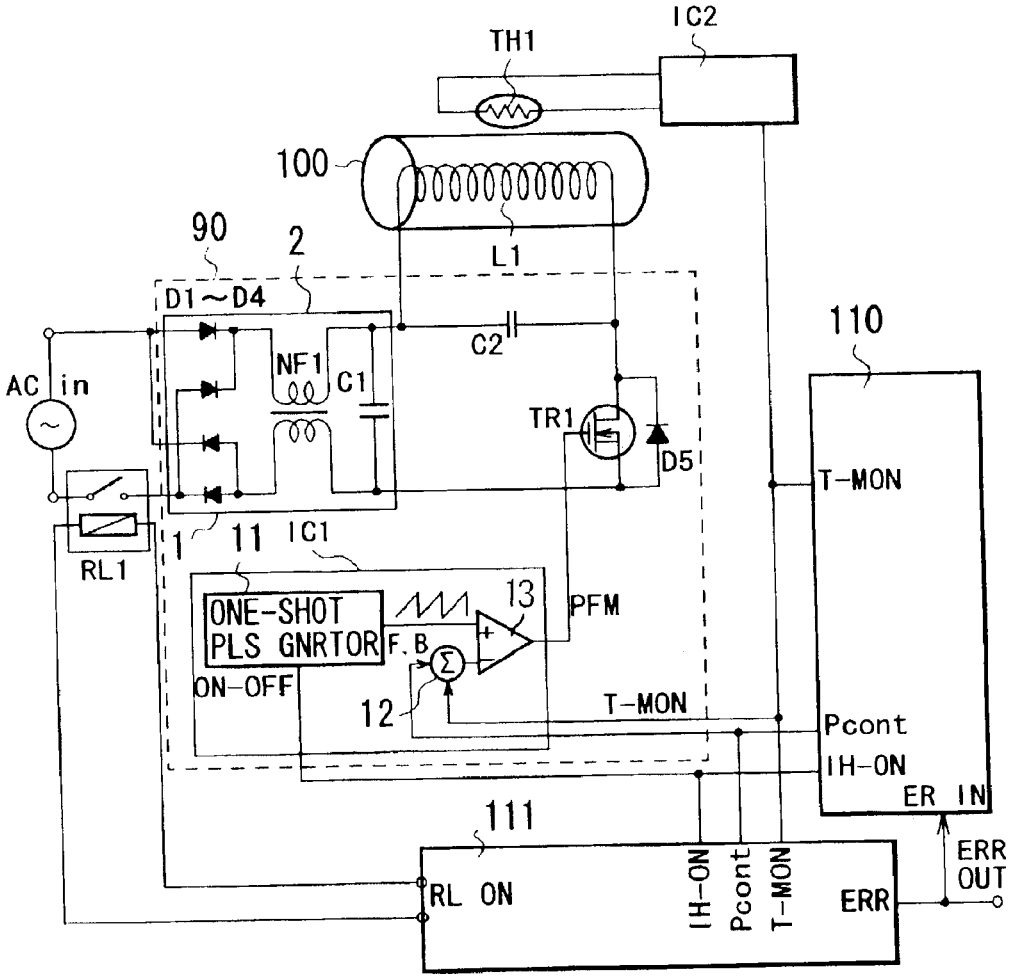
FIG. 1 is a schematic block diagram of an induction heating apparatus in Embodiment 1 of the present invention.
Figure 2:
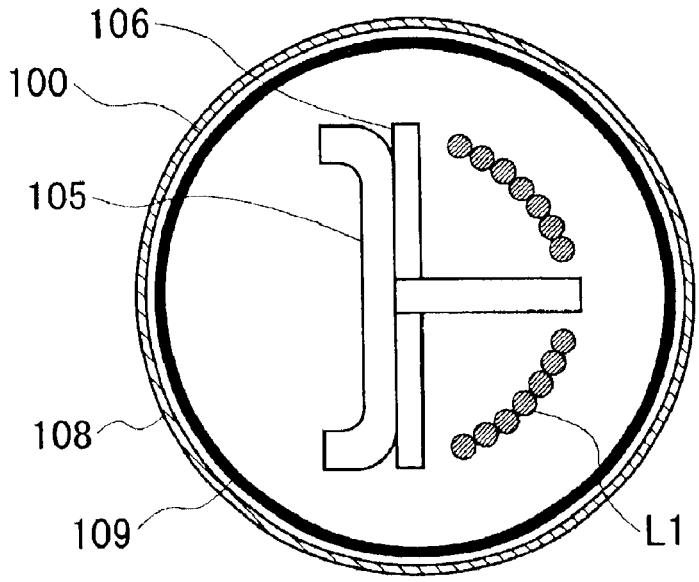
FIG. 2 is a detailed illustration of an inside structure of the fixing roller.
Figure 3:
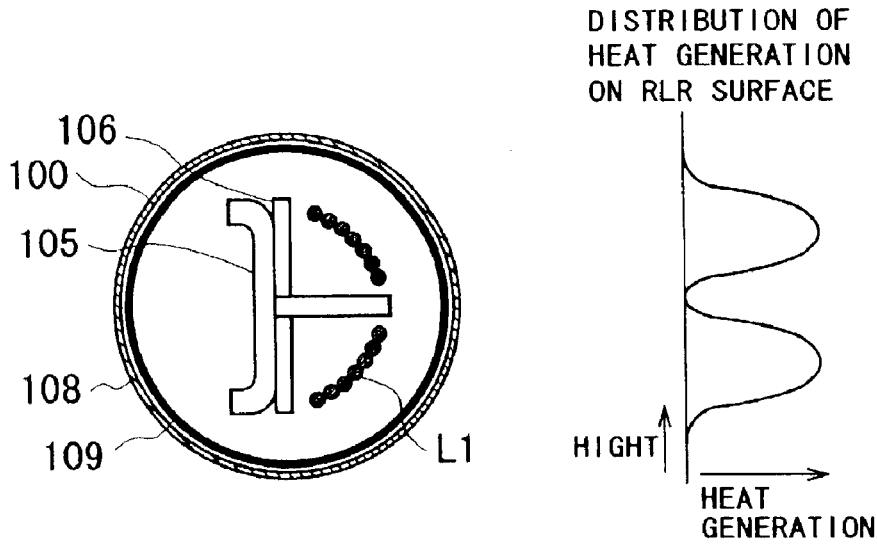
FIG. 3 is an illustration of a heat generation distribution of the fixing roller.
Figure 4:
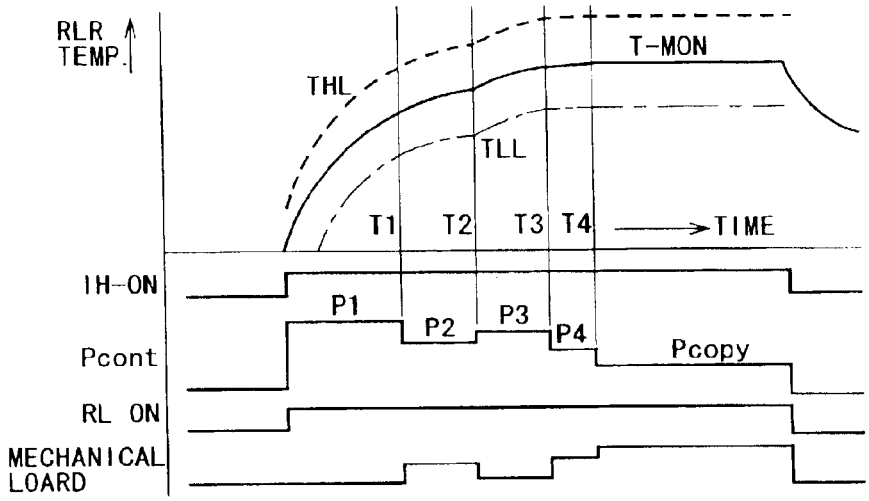
FIG. 4 is an illustration of a normal sequence profile upon temperature raising.
Figure 5:
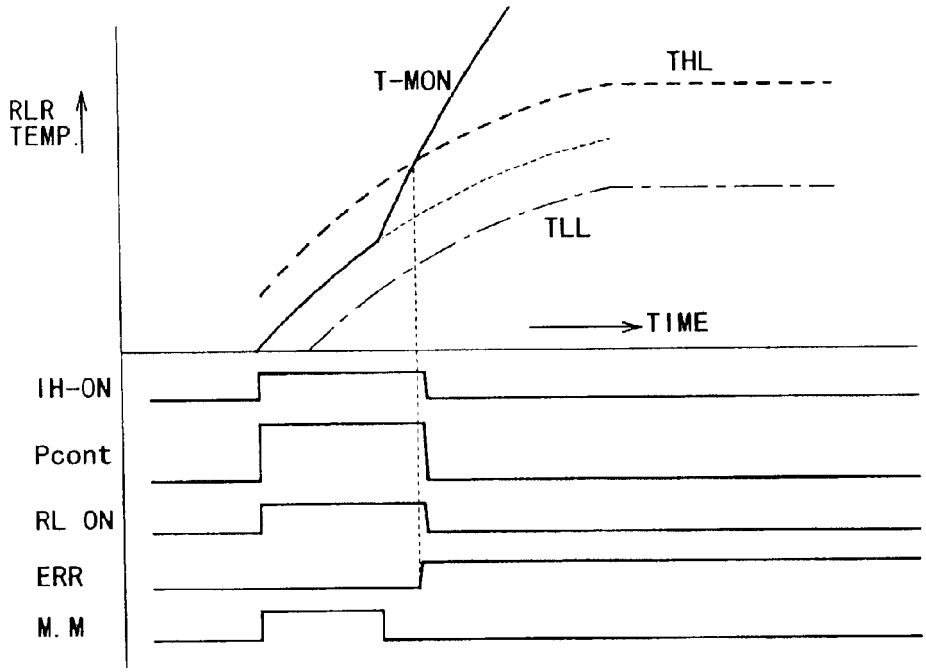
FIG. 5 is an illustration of an abnormality sequence profile upon temperature raising.
Figure 6:
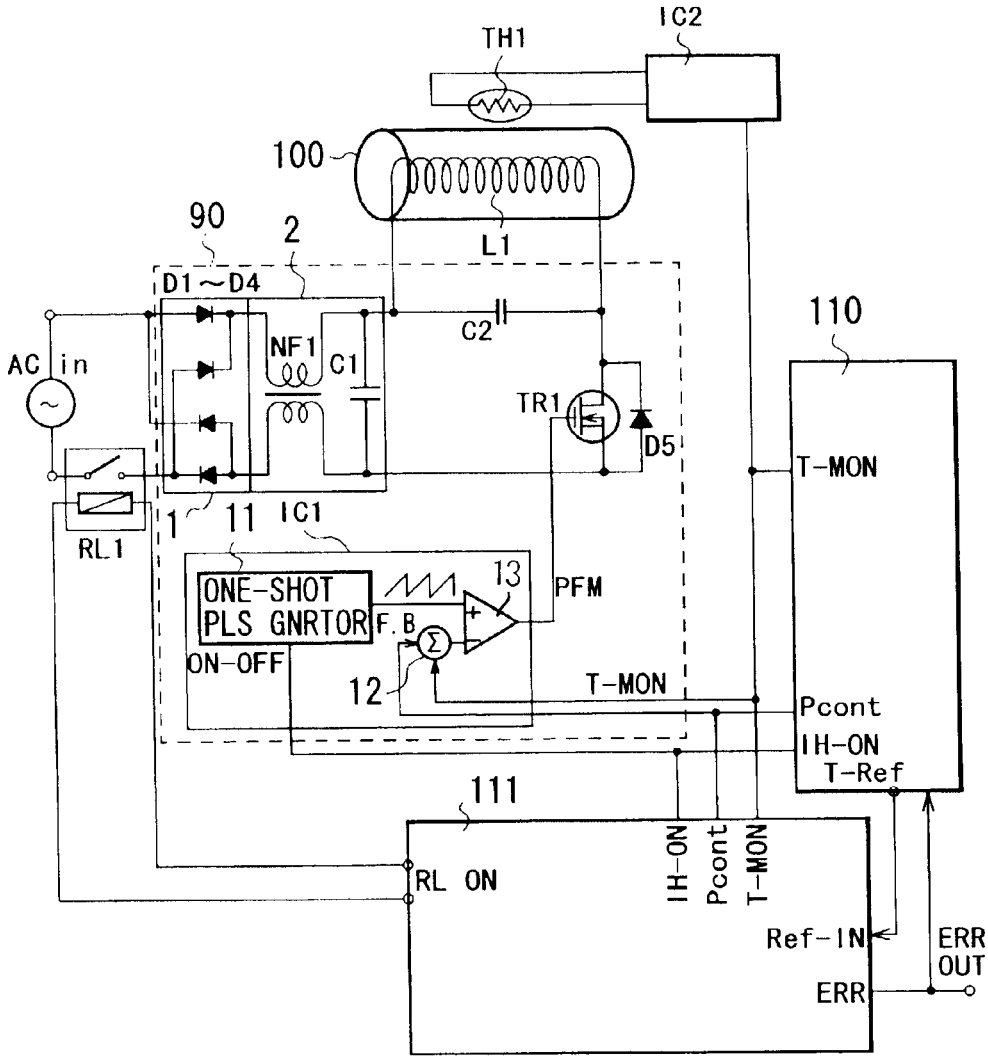
FIG. 6 is a schematic block diagram of an induction heating apparatus in Embodiment 1 of the present invention.
Figure 7:
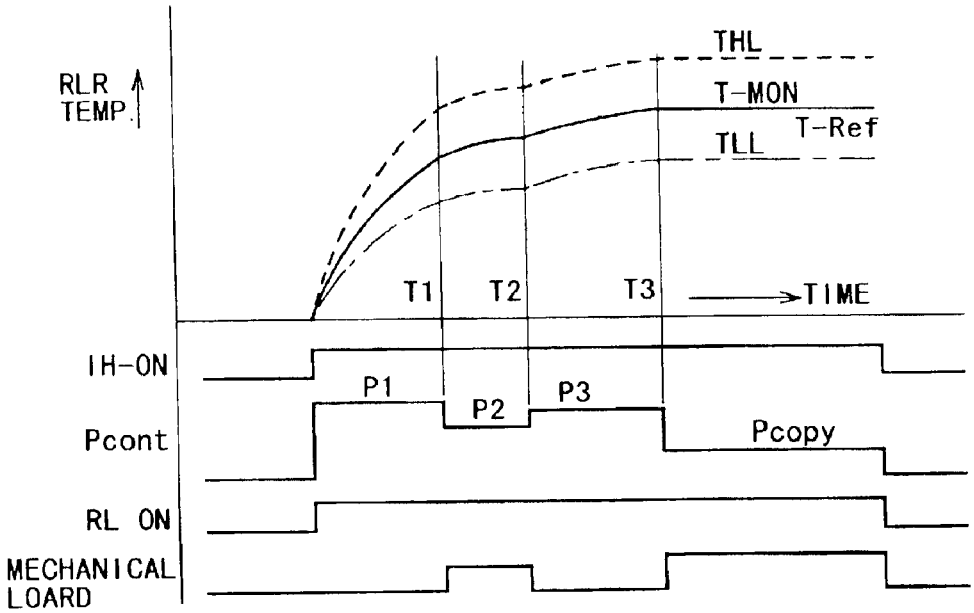
FIG. 7 is an illustration of abnormality discrimination on the basis of temperature information wherein a temperature reference profile is produced by an electric power control circuit.
Figure 8:
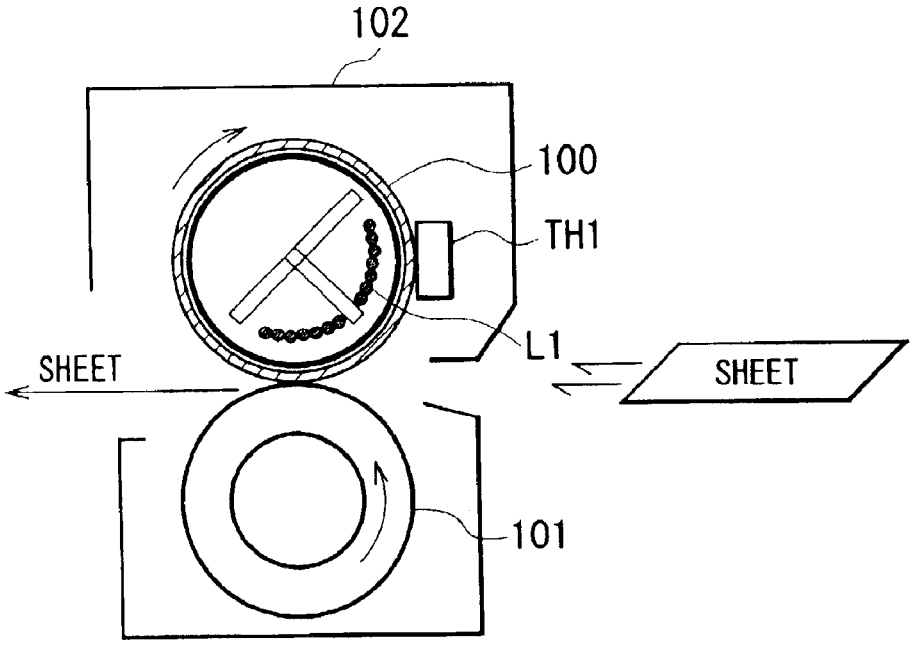
FIG. 8 shows an induction heating apparatus in the form of a fixing device.
Figure 9:
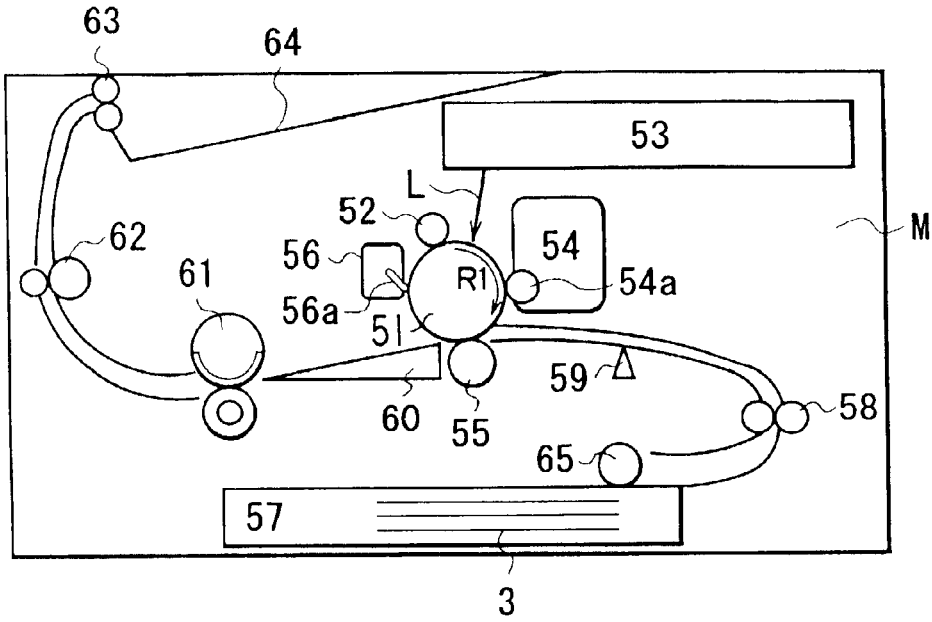
FIG. 9 illustrates an induction heating apparatus in the form of an image forming apparatus.

FIG. 1 is a schematic block diagram of an induction heating apparatus in Embodiment 1 of the present invention. FIG. 2 is a detailed illustration of an inside structure of the fixing roller. FIG. 3 is an illustration of a heat generation distribution of the fixing roller. FIG. 4 is an illustration of a normal sequence profile upon temperature raising. FIG. 5 is an illustration of an abnormality sequence profile upon temperature raising. FIG. 6 is a schematic block diagram of an induction heating apparatus in Embodiment 1 of the present invention. FIG. 7 is an illustration of abnormality discrimination on the basis of temperature information wherein a temperature reference profile is produced by an electric power control circuit. FIG. 8 shows an induction heating apparatus in the form of a fixing device. FIG. 9 illustrates an induction heating apparatus in the form of an image forming apparatus. In these Figures, the same reference numerals are assigned to the elements having corresponding functions, and the detailed description is not repeated for simplisity.

FIG. 9 is a cross-section of an image forming apparatus provided with a fixing device (heating apparatus) according to an embodiment of the present invention, wherein the image forming apparatus is a laser beam printer as an exemplary apparatus. The description will be made as to the image forming apparatus. The electrophotographic photosensitive member in the form of a drum (image bearing member) 51 is rotatable Lines supported on a main assembly M of the apparatus, and is rotated at a predetermined process speed in the direction indicated by an arrow R1 by driving means (unshown). Around the photosensitive drum 51, there are provided a charging roller (charging device) 52, exposure means 53, a developing device 54, a transfer roller (transferring device) 55 and a cleaning device 56 in the order named. Below the main assembly M of the apparatus, there is provided a cassette 57 accommodating material to be heated 3 in the form of sheets. The feeding path for the material to be heated P comprises, from the upstream side, a sheet feeding pick-up 65, feeding rollers 58, a top sensor 59, a feeding guide 60, fixing device 61 using the heating apparatus of the present invention and including a pair of a feeding roller 62 and a discharging roller 63, and discharge tray 64. The description will be made as to the operation of the image forming apparatus.

The photosensitive drum 51 is rotated in the direction indicated by arrow R1 by driving means (unshown), during which it is uniformly charged to a predetermined potential of a predetermined polarity by the charging roller 52. The photosensitive drum 51 having been electrically charged by the charging roller, is exposed to image light by exposure means 53 including a laser optical system or the like, so that charge of the exposed portion is removed, and therefore, an electrostatic latent image is formed. The electrostatic latent image is developed by the developing device 54. The developing device 54 comprises a developing roller 54*a*, and the developing roller 54*a* thereof is supplied with a developing bias, so that toner is electrostatically deposited onto the electrostatic latent image on the photosensitive drum 51, by which a toner image is formed. The toner image is transferred onto the material to be heated 3 by the transfer roller 55. The material to be heated 3 is accommodated in the cassette 57, and are fed out by the pick-up roller 65 and the feeding rollers 58, and is then fed to a transfer nip formed between the photosensitive drum 51 and the transfer roller 55 at the proper timing using the top sensor 59. At this time, the leading end of the material to be heated 3 is detected by the top sensor 59 and is synchronized with the unfixed toner image on the photosensitive drum 51. The transfer roller 55 is supplied with a transfer bias, so that toner image is transferred to the material to be heated 3 at the predetermined position from the photosensitive drum 51. The material to be heated 3 carrying the toner image (unfixed) on its surface, is fed to the fixing device 61 along the feeding guide 60, where the unfixed toner image is heated and pressed, by which it is fixed on the surface of the material to be heated 3. The material to be heated 3, after the toner image is fixed, is fed and discharged onto the discharge tray 64 of the main assembly M of the apparatus. On the other hand, the photosensitive drum 51 after the toner image is transferred, the residual toner (untransferred toner) remaining on the surface of the photosensitive drum 51 is removed by a cleaning blade 56*a* of the cleaning device 56, and the photosensitive drum 51 is prepared for the next image forming operation. By repeating the above-described operations, the image forming operations are sequentially carried out. Referring to FIG. 1, the description will be made as to the induction heating apparatus according to the embodiment of the present invention. In FIG. 1, designated by TR1 is an electric power switching element such as a MOS-FET or the like; C2 is a resonance capacitor for providing a resonance waveform from a high frequency AC to be applied to the dielectric heating coil L1 which is a load; and D5 is a flywheel diode for regenerating the electric power accumulates in the induction heating coil L1 connected in parallel with the electric power switching element TR1.

Designated by TH1 is a temperature detecting element (temperature detecting means) and is disposed proposed to the pollution of the fixing roller (heating member) 100 which generates the largest amount of heat. The temperature detecting element TH1 is generally a temperature sensing resistance element such as a thermister or the like, and the output there is inputted to the temperature detecting circuit IC2.

The temperature detecting circuit IC2 outputs a voltage value which corresponds to the change in the electrical resistance of the temperature detecting element TH1 which changes with the temperature, the output is a temperature signal T-MON. The temperature signal T-MON is surprised to an electric power control circuit (electric power control means) 110, to a resonance control circuit IC1 of the electric power application circuit (electric power applying means) 90 and to an abnormality detection circuit (abnormality detecting means) 111. The electric power control means 110 determines an electric power supplying operation through the fixing roller 100 in accordance with the state operation of the image forming apparatus (unshown), and determines the electric power amount (electric power instruction value Pcont) upon the electric power application and during the electric power supply. The electric power instruction value Pcont is determined in accordance with the state of operation of the image forming apparatus, and the target value is changed upon necessity.

The resonance control circuit IC1 includes a one-shot pulse generating circuit 11, a processing circuit 12 and a comparison circuit 13, and the processing circuit 12 receives the temperature signal T-MON and the electric power instruction value Pcont outputted from the electric power control means 110. The one-shot pulse generating circuit 11 is supplied with the operation permission signal IH-ON output from the electric power control means 110.

Here, the electric power instruction value Pcont inputted from the electric power control means 110 to the resonance control circuit IC1 is inputted to the pulse modulation (PFM) oscillation circuit as an electric power control signal. The resonance control circuit IC1 generates PFM pulses corresponding to the electric power control signal value to the gate of the electric power switching element TR1 to rendering on and off the electric power switching element.

The electric power supplied from the commercial AC voltage source AC is rectified by a rectifying circuit 1 constituted by diode D1–D4 which are connected into a bridge circuit, and is converted to a DC by a smoothing circuit 2 comprising a noise filter NF1 and a smoothing capacitor C1. The noise filter NF1 and the smoothing capacitor C1 are such that sufficient attenuation amount is assured for the frequency of the electric power switching element TR1 and such that substantially no attenuation is assured fro the voltage source frequency. The electric power application circuit 90 is constituted by the rectifying circuit 1, the smoothing circuit 2, the resonance capacitor C2, the temperature detecting element TH1, the resonance control circuit IC1 and so on.

The fixing roller 100, as shown in FIG. 2, includes a roller core metal 109, a rubber layer 108 on the outer surface thereof, a ferrite core 106 having a T-shaped cross-section disposed at the inner central portion, a supporting member 101 supporting the ferrite core 106, and an arcuate induction heating coil L1 extending along the inner surface of the roller core metal 109 between the opposite ends of the ferrite core. By this structure, the heat generation distribution is generated on the surface of the fixing roller 100.

The description will be made as to the operation.

When the electric power control circuit 110 receives a heating signal upon the start of the copying operation, the operation permission signal IH-ON and the electric power instruction value Pcont are outputted to resonance control circuit IC1 of the electric power application circuit 90 and to the abnormality detection circuit 111 in accordance with the state of the copying operation. The circuit 111 receives the operation permission signal IH-ON and the electric power instruction value Pcont to produce a relay operation signal RL-ON to close the relay RL1, thus supplying the AC input voltage to the electric power application circuit 90.

When the AC input voltage is supplied to the input contact of the electric power application circuit 90 by this operation, the voltage rectified by the rectifying circuit 1 constituted by the diode D1–D4 into a pulsating flow voltage, is applied across the capacitor C1 through the noise filter NF1 of the smoothing circuit 2. By this, the end-to-end voltage of the capacitor C1 forms a waveform provided by rectifying the AC input voltage.

From the electric power control circuit 110, the electric power instruction value Pcont corresponding to the state of the operation of the apparatus is applied to the resonance control circuit IC1 as a control signal, and the resonance control circuit IC1 generates a PFM pulse corresponding to the electric power instruction value Pcont. The PFM pulse generated by the resonance control circuit IC1 is applied across the gate-sources, by which the electric power switching element TR1 is switched to permit flow of the drain current ID, thus supplying the electric power to the induction heating coil L1.

The induction heating coil L1 stores the current provided by actuation of the electric power switching element TR1, and therefore, when the electric power switching element TR1 is deactuated, a counterelectromotive force is generated to electrically charge the resonance capacitor C2 with the cumulative current, thus raising the charged voltage of the resonance capacitor.

The current flown out of the induction heating coil L1 attenuates inverse-proportionally to the rising of the voltage across the resonance capacitor C2. After passing through an instance when no coil current flows, the current provided by the charge accumulated in the resonance capacitor C2 inversely flows out into the induction heating coil L1.

Simultaneously with the charge accumulated in the resonance capacitor C2 returning to the induction heating coil L1, the voltage of the resonance capacitor C2 lowers so that the drain voltage of the electric power switching element TR1 lowers beyond the source voltage to actuate the flywheel diode D5, thus flowing the forward current.

When the electric power switching element TR1 is actuated thereafter, the current flows through the induction heating coil L1, and the current is accumulated in the induction heating coil. These operations are repeated, with the result that induced current flows through the fixing roller 100 which is a load opposed to and therefore electromagnetically connected with the induction heating coil L1. By this, joule heat is generated therein which is the resistance value of itself multiplied with the induced current square, so that inner surface efficiently generates heat, and the entirety of the fixing roller which is rotation is heated.

Here, the current flowing through the electric power switching element TR1 and the induction heating coil L1 is smoothed by the capacitor C1 charging and discharging the high frequency component. Accordingly, the high frequency current does not flows through the noise filter NF1, and only the AC having the rectified input current waveform flows.

The current waveform of the current flowing through the electric power switching element TR1 and the induction heating coil L1 is the one filtered by the smoothing circuit 2 including the capacitor C1 and the noise filter NF1, and therefore, the AC input current waveform before the rectification is close to the AC input voltage waveform, so that higher harmonics wave component included in the input current can be significantly decreased, and the power factor of the input current of the smoothing circuit 2 can be significantly improved.

The smoothing circuit 2 comprising the noise filter NF1 and the capacitor C1 may be any if the filtering effect functions to the oscillation frequency of high frequency provided by the resonance control circuit IC1 since the capacity of the capacitor C1 and the inductance value of the noise filter NF1 can be small, and therefore, downswing and weight saving is accomplished.

By inputting the electric power temperature control signal to the induction heating actuating power source circuit, a high frequency AC electric power of approx. 20 KHz–1 MHz is generated at the output terminal of the induction heating power source.

The output of the temperature detecting element TH1 for detecting the temperature of the surface of the fixing roller is inputted to the temperature detecting circuit IC2 at proper timing, and is inputted to the electric power control circuit 110 as a temperature signal T-MON the detected temperature is compared with the target temperature at proper timing. The difference from the target value is fed back to the resonance control circuit IC1 as an electric power instruction value Pcont.

When the detected temperature detected by the temperature detection circuit IC2 approaches to the predetermined temperature information (set target temperature), the electric power control circuit 110 produces a feed-back signal to decrease the applied high frequency electric power so as to keep the surface temperature of the fixing roller at a constant level through a control system proportional control or so-called PID control. The resonance control circuit IC1 is supplied with the difference from the set target temperature detected by the electric power control circuit 110, that is, the electric power instruction value Pcont. In accordance with the electric power instruction value Pcont, the gate ON time of the electric power switching element TR1 is determined, so that supplied electric power of the electric power switching element TR1 is adjusted. As a result, the electric power inputted to the induction heating coil L1 is controlled, and the heating value of the fixing roller is controlled, by which the toner fixing temperature is stabilized.

In the fixing device of the induction heating type, the temperature control is carried out through the above-described sequence. The material of the fixing roller 100 used with the induction heating is usually steal, ferro-alloy or the like from the standpoint of cost and/or heat generation property.

However, the fixing roller 100 of ferromaterial exhibits low thermo-conductivity. In order to uniformly heat the surface of fixing roller, the fixing roller 100 is rotated from the start of the application of electric power with the pressing roller 101 contacted thereto. This makes the surface temperature of the fixing roller 100 uniform.

The description will be made as to the operation at the start of the heating operation.

The fixing roller is supplied with the electric energy by the electric power supplying means until the fixable temperature is reached. FIG. 4 shows a normal sequence profile upon the temperature raising operation. In this Figure, a temperature signal T-MON is indicative of the temperature of the fixing device actually sensed by the temperature detecting element TH1. The curve indicates that temperature rising in the case of the normal operation. Designated by THL is a high temperature abnormality detection level (first temperature discrimination reference) of the abnormality detection circuit 111, and TLL is a low temperature abnormality detection level (second temperature discrimination reference). The description will be made as to the sequential start-up operation. The electric power control circuit 110 receives the electric power supply signal of the main assembly of the image forming apparatus and starts the start-up operation for the fixing device. At this time, the electric power control circuit 110 detects the state of the temperature of the fixing roller 100 on the basis of the output voltage value of the temperature detecting circuit IC2. For example, when the surface temperature of the fixing roller 100 upon the main switch actuation is lower than the fixable temperature, the start-up situation is discriminated and a rotational driving signal for the fixing roller 100 (unshown)is outputted, and also outputs an electric power instruction value Pcont and an operation permission signal IH-ON.

The operation permission signal IH-ON and the electric power instruction value Pcont are received by the abnormality detection circuit 111, and a relay operation signal RL-ON is outputted to close the relay RL1 so that AC input voltage is applied to the electric power application circuit 90, by which the electric power supply to the induction heating coil L1 is started. At this time, the electric power instruction value Pcont in FIG. 4 showing the electric power supply sequence is the maximum electric power P1 that is applicable upon the start-up of the image forming apparatus, since various electrical and mechanical load elements of the image forming apparatus are at rest.

After a certain time period collapses, the surface temperature of the fixing roller 100 reaches a predetermined temperature, the signal indicative of this event is received by the electric power control circuit 110, and then various electrical and mechanical elements required for image forming operation of the copying machine start to receive the electric power supply. This timing is indicated by T1 FIG. 4. In this example of the sequential operation, an example is shown wherein in order to control for stabilization of the image forming process, for example, the stabilization of the photosensitive drum or the like in the image formation system, the photosensitive drum is rotated (preliminary multi-rotation) which leads to increase of the mechanical load. In the image fixing system, the electric power instruction value Pcont is P2 which means a decreased electric energy consumption of the mechanical elements to supply sufficient electric power to the mechanical elements in the image formation system.

The preliminary multi-rotation step ends at T2 in FIG. 4, and thereafter, the potential control or the like operation for adjusting the charge amount on the photosensitive drum begins. In this state, the electric energy consumption for the mechanical load element is smaller than before, the electric power instruction value Pcont which can be applied to the fixing system is larger, and therefore, P3 which is larger than P2 is used.

At a certain point of time thereafter, or when the predetermined temperature with which the image fixing operation is capable, the original carriage scanner, the polygonal mirror motor driving of the laser writing system or the like begins. The operation timing is indicated by T3 on the electric power supply sequence in FIG. 4. Then, the directly preliminary operations are carried out, the mechanical and electrical load elements consume corresponding electric power. Therefore, the mechanical and electrical load elements consume increased electric power. Then, in the fixing system, the electric energy consumption of the fixing system is decreased to P4 (electric power instruction value Pcont) so as to permit the increase of the electric energy consumption.

Thereafter, when the surface temperature of the fixing roller 100 reaches the predetermined fixing temperature, the copying operation of the copying machine is enabled, so that print output becomes possible in response to instructions on an operating panel or remote instructions.

Figure 10:
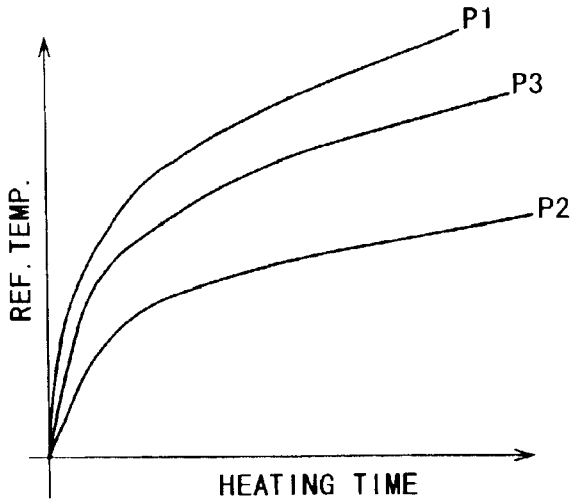
FIG. 10 shows a rising curve of the fixing roller connected with an abnormality detection circuit.
Figure 11:
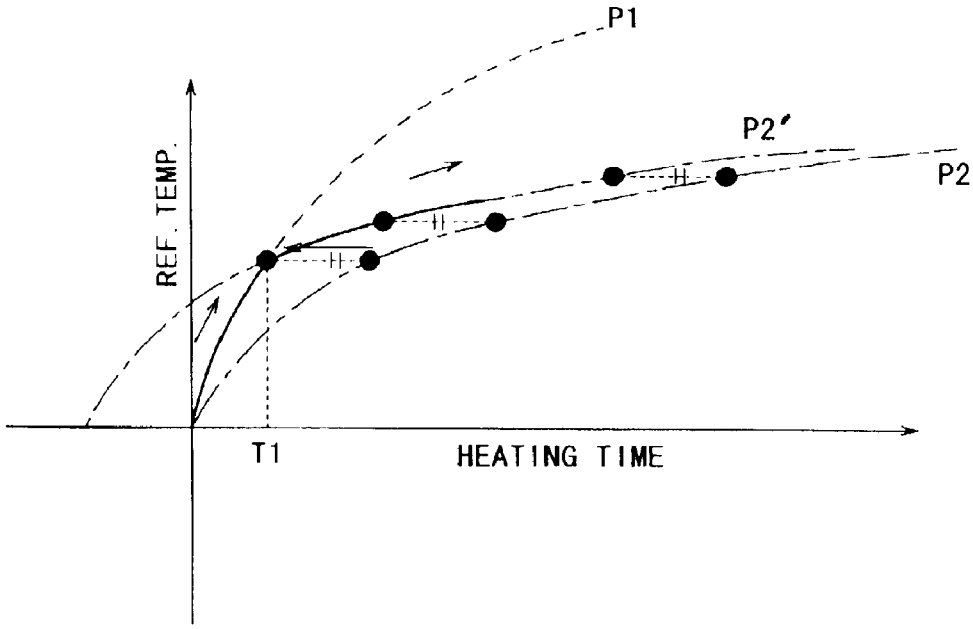
FIG. 11 shows a temperature rising curve which is a reference when a high temperature abnormality detection level THL and the low temperature abnormality detection level TLL are set.
Figure 12:
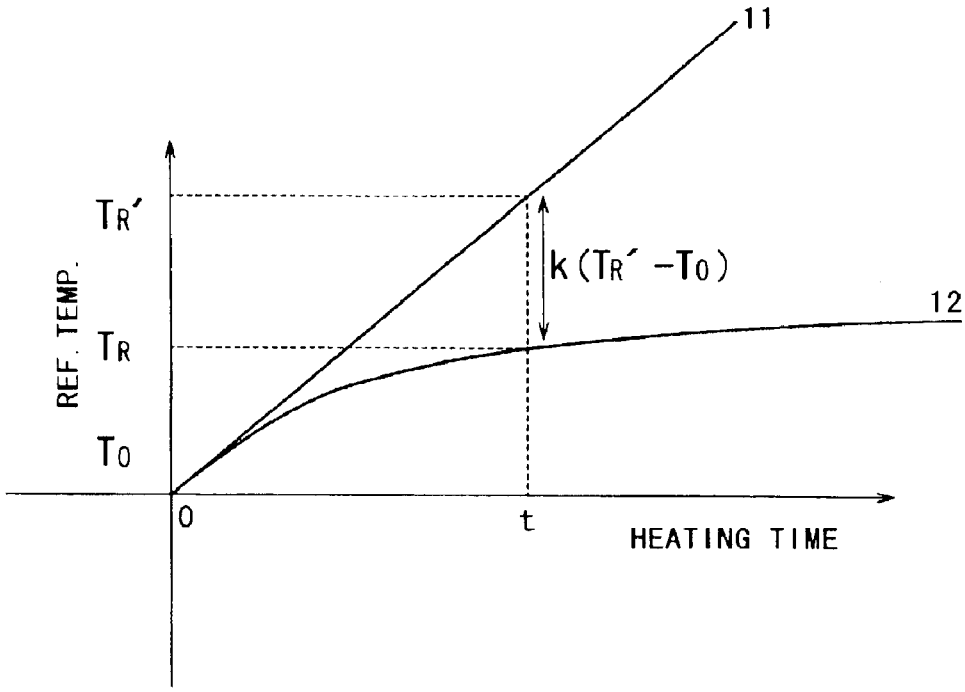
FIG. 12 is a temperature rising curve of a fixing roller when the presence or absence of the heat release is taken into consideration.

When such a raising sequence is used, the electric power instruction value Pcont, the high temperature abnormality detection level (first temperature discrimination reference) corresponding to the Pcont target value THL value and the low temperature abnormality detection level (second temperature discrimination reference) TLL value, are set in accordance with the various states of operations. Examples of setting the abnormality detection level THL, high temperature abnormality detection level (first temperature discrimination reference), TLL low temperature abnormality detection level (second temperature discrimination reference. FIG. 10 shows an ideal temperature rising curve when the fixing roller is heating in good order. Curves P1, P2, P3 are fixing roller temperature rising curves when the fixing roller is heated with the P1, P2, P3 of f electric power instruction value Pcont. The abnormality detection circuit 111 has data indicative of the temperature risings with such determined electric power supplies. The abnormality detection circuit 111 sets THL, TLL on the basis of the electric power instruction value Pcont from the electric power control circuit 110 and the heating time, and compares the detected temperature fed from the temperature detecting circuit IC with them. Referring to FIG. 11, the description will be made as to the specific setting method for the THL, TLL. FIG. 11 shows a temperature rising curve which constitutes a reference to be used for setting the high temperature abnormality detection level THL and the low temperature abnormality detection level TLL. Curves P1, P2 represent ideal rising curves when the fixing roller is heated in good order with P1, P2 of the electric power instruction value Pcont. When the electric power instruction value Pcont is P1, the temperature of the fixing roller traces the thick curve P1. When the electric power instruction value Pcont changes to P2 at the point of time T1, the temperature of the fixing roller traces the thick line P2 which is a line translated in the direction of time axis. A temperature rising curve by connecting such ideal temperature rising curves for the respective electric power instruction values is used as a reference line, and THL is determined as a curve which is higher than the reference line by a predetermined temperature, and TLL is determined as a curve which is lower than that by a predetermined temperature. The THL line and the TLL line may be determined as lines which are higher and lower by predetermined percentages relative to the reference line. The abnormality detecting means 111 keeps the thus determined THL and TLL curves obtained from the reference curve as time series temperature rising data, and the abnormality detection circuit 111 reads out the THL and TLL data in accordance with the electric power instruction value Pcont from the electric power control circuit 110 and the heating time, and compares the detected temperature from the temperature detecting circuit IC with them, thus discriminating whether the apparatus is normal or not. As another example of THL and TLL setting, the abnormality detecting means does not keep such time series data, but keeps a mathematical expression indicative of the ideal temperature rising curve on the assumption that fixing roller is heated in order. An example of a mathematical expression of the ideal temperature rising curve on the assumption that fixing roller is heated in order, will be described. Such an ideal temperature rising curve is supposed to be determined as a phantom temperature rising curve (line 11) of the fixing roller on the assumption that there is no heat release (curve 12 in FIG. 12), deducted by a curve of released heat quantity. Then, the temperature TR of the fixing roller which has been heated for t hours from the start of heating is expressed as the following mathematical expression:

$$TR=(P/C)\times t-k(TR-T0)$$

where TR is a temperature of the fixing roller on the assumption that there is no heat release in the heating period; T0 is an ambient temperature of the apparatus; P is the electric power supplied to the fixing roller; C is a thermal capacity of the fixing roller; and k is a proportional constant. The temperature TR of the fixing roller obtained in consideration of the heat release is used as a reference, and the THL curve is determined as a curve which is higher by a predetermined temperature than the reference curve, and the TLL curve is determined as a curve which is lower by a predetermined temperature than the reference curve. The THL line and the TLL line may be determined as lines which are higher and lower by predetermined percentages relative to the reference line. In this manner, the circuit 111 calculates at proper timing the reference fixing roller temperature TR on the basis of the electric power instruction value Pcont from the electric power control circuit 110 and the heating time, and the THL and TLL are set on the basis of the calculation. The detected temperature from the temperature detecting circuit IC is compared with them, and the discrimination is made as to whether or not the apparatus is in order.

The image forming apparatus use the induction heating type is different from the heating method using a heat generation source having a heat generating electric power which is inherent to the heat source such as the halogen lamp in that temperature control function can be accomplished using any electric power instruction value Pcont. Therefore, the electric power value supplied to the heating fixing device can be changed during the period from the heating roller 100 cold state which occurs at the time of start of the electric power supply to the image forming apparatus to the image-fixable temperature state, and therefore, the start-up time period of the image forming apparatus can be reduced.

Referring to FIG. 5 showing the electric power supply sequence, in the fixing device using the induction heating, if the motor (M. M) for rotating the fixing device stops for some reason or another, for example, only a part of the fixing roller generates heat, as shown in FIG. 3 with the result of non-uniform temperature distribution, and the temperature rising at this part is very steep as shown in FIG. 5. If the use is made with a conventional temperature detecting means such as those using bimetal or temperature sensing fusing metal, a significantly long time is required until the cutting temperature is reached with the result that excessive temperature rise detection is not correctly carried out, and therefore, a high sensitivity element which is expensive has to be used.

According to the embodiment of the present invention, a temperature detecting element such as thermister is disposed substantially at a position of the fixing roller where the heating value is the largest. The abnormality detecting means 111 shuts off the electric power supply to the electric power applying means 90 when the detected temperature which is detected in predetermined time series upon the start-up of the heating member becomes out of a temperature range which is predetermined in accordance with the electric power control signal Pcont. Thus, the temperature abnormality can be detected, and the temperature can be raised at high speed. In this manner, the safety of the fixing device can be significantly improved.

The electric power control signal Pcont determines the electric power supplying operation to the fixing roller 100 in accordance with the operational state of the image forming apparatus (unshown), and the electric power amount (electric power instruction value) during the electric power application and electric power supply are determined. By doing so, when the electric power is required by other than the fixing device, the electric power control signal Pcont changes correspondingly, and the abnormality detection range can be set. Therefore, even when the electric power instruction value changes due to the change of the operational state of the apparatus, the corresponding abnormality detection range can be set. Thus, the safety is significantly improved in the fixing device wherein the temperature can be quickly raised.

Embodiment 2

FIG. 6 is a schematic block diagram of the device and method in another embodiment of the present invention. In this embodiment, the electric power control circuit 110 is given the function of keeping and outputting in time series the temperature rising level in the case of normal operation (reference). Simultaneously with outputting the operation permission signal IH-ON and the electric power instruction value Pcont, the normal temperature rising output level is supplied to the abnormality detecting circuit 111 as a temperature reference signal T-Ref.

In the abnormality detecting circuit 111, the abnormality detection level is set on the basis of the temperature reference signal TRef supplied from the electric power control circuit 110. For example, as shown in FIG. 7, the high temperature abnormality detection level THL is determined as 1.2 times the temperature reference signal T-Ref, and the low temperature abnormality detection level TLL is determined as 0.8 times the temperature reference signal T-Ref, thus providing the upper and lower limits.

With this structure, it is not necessary for the abnormality detection circuit 111 to keep the time series temperature rising profile, so that abnormality detection circuit 111 can be made simple and can be made more widely usable. In addition, the detection levels are provided by the temperature reference signal T-Ref multiplied by coefficients, and therefore, when the fixing roller temperature is low (low temperature side), the detection width is small, and when it is close to the target temperature (high temperature side), the detection width is large, the detection accuracy is improved.

The temperature detecting element in the Figure has been described as being a thermister, but another temperature detecting element such as thermocouple, platinum temperature measuring wire, thermo pile or the like is usable.

In the foregoing embodiments, the heating apparatus of the present invention is used for the fixing device. However, the present invention is applicable to a heating apparatus for uncreasing a material to be heated or for heating it by increasing surface gloss to improve the quality.

While the invention has been described with reference to the structures disclosed herein, it is not confined to the details set forth and this application is intended to cover such modifications or changes as may come within the purpose of the improvements or the scope of the following claims.

What is claimed is:

1. A fixing device comprising:

magnetic field generating means for generating a magnetic field;

a heat generating member for generating heat by said magnetic field, wherein an image on a recording material is fixed by the heat from said heat generating member;

electric power supply means for electric power supply to said magnetic field generating means;

electric power changing means for changing electric power to said magnetic field generating means;

a temperature detecting member for detecting a temperature of said heat generating member;

electric power shut-off means for determining whether to shut off electric power supply to said magnetic field generating means on the basis of a comparison of a detected temperature provided by said temperature detecting member with a reference temperature during a period from start of heating to reaching a predetermined temperature and for shutting off the electric power supply in accordance with the determination, the reference temperature being determined on the basis of a heating period of said heat generating member and the electric power supply by said electric power supply means; and reference temperature changing means for changing, when said electric power changing means changes the electric power supply, the reference temperature on the basis of the electric power supply which has been changed.

2. An apparatus according to claim 1, wherein said reference temperature is an upper limit temperature, and wherein said electric power shut-off means shuts off the electric power supply to said magnetic field generating means when an output of said temperature detecting member indicates a temperature at least the upper limit temperature.

3. An apparatus according to claim 1, wherein said reference temperature is a lower limit temperature, and wherein said electric power shut-off means shuts off the electric power supply to said magnetic field generating means when an output of said temperature detecting member indicates a temperature not higher than the lower limit temperature.

4. An apparatus according to claim 1, wherein said electric power supply means controls the electric power supply so as to maintain the detected temperature at a predetermined level.

5. An image forming apparatus comprising:

image forming means for forming a toner image on a recording material;

magnetic field generating means for generating a magnetic field;

a heat generation member for generating heat by said magnetic field, wherein an image on a recording material is fixed by the heat from said heat generation member;

electric power supplying means for electric power supply to said magnetic field generating means;

electric power changing means for changing electric power supply to said magnetic field generating means, said electric power changing means changing the electric power supply to said magnetic field generating means in accordance with an operation other than heat generation of said heat generation member;

a temperature detecting member for detecting a temperature of said heat generation member; and electric power shut-off means for determining whether to shut off electric power supply to said magnetic field generating means on the basis of a comparison of a detected temperature provided by said temperature detecting member with a reference temperature during a period from start of heating to reaching to a predetermined temperature and for shutting of the electric power supply in accordance with the determination; and reference temperature changing means for changing, when said electric power changing means changes the electric power supply, the reference temperature on the basis of electric power which has been changed.

6. An image forming apparatus comprising:

image forming means for forming a toner image on a recording material;

a magnetic field generating means for generating a magnetic field;

a heat generation member for generating heat by said magnetic field, wherein an image on a recording material is fixed by the heat from said heat generation member;

electric power supplying means for supplying electric power to said magnetic field generating means;

electric power changing means for changing an electric power supply to said magnetic field generating means, said electric power changing means changing electric power supply to said magnetic field generating means in accordance with an operational state of said image forming means;

a temperature detecting member for detecting a temperature of said heat generation member;

electric power shut-off means for determining whether to shut off electric power supply to said magnetic field generating means on the basis of a comparison of a detected temperature provided by said temperature detecting member with a reference temperature during a period from start of heating to reaching a predetermined temperature and for shutting off the electric power supply in accordance with the determination; and reference temperature changing means for changing, when said electric power changing means changes the electric power supply, the reference temperature on the basis of electric power which has been changed.

7. An apparatus according to claim 6, wherein said reference temperature is an upper limit temperature and wherein said electric power shut-off means shut off the electric power supply to said magnetic field generating means when an output of said temperature detecting member indicates a temperature at least the upper limit temperature.

8. An apparatus according to claim 6, wherein said reference temperature is a lower limit temperature, and wherein said electric power shut-off means shuts off the electric power supply to said magnetic field generating means when an output of said temperature detecting member indicates a temperature not higher than the lower limit temperature.

9. An apparatus according to claim 6, wherein said electric power supplying means controls the electric power supply to said magnetic field generating means so as to maintain the detected temperature at a predetermined level.

10. An image forming apparatus comprising:

image forming means for forming a toner image on a recording material;

fixing means for fixing a toner image on the recording material;

electric power supplying means for supplying electric power to said fixing means;

electric power changing means for change electric power supply to said electric power supplying means in accordance with an operational state of said image forming means;

temperature detecting member for detecting a temperature of said fixing means;

electric power shut-off means for determining whether to shut off electric power supply by said electric power supplying means on the basis of comparison of a detected temperature provided by said temperature detecting member with a reference temperature during a period from start of heating to reaching to a predetermined temperature and for shutting off the electric power supply in accordance with the determination; and reference temperature changing means for changing, when said electric power changing means changes the electric power supply, the reference temperature on the basis of electric power which has been changed.

11. An apparatus according to claim 10, wherein said reference temperature is an upper limit temperature, and wherein said electric power shut-off means shuts off the electric power supply by said electric power supplying means when an output of said temperature detecting member indicates a temperature at least the upper limit temperature.

12. An apparatus according to claim 10, wherein said reference temperature is a lower limit temperature, and wherein said electric power shut-off means shuts off the electric power supply of said electric power supplying means when an output of said temperature detecting member indicates a temperature not higher than the lower limit temperature.

13. An apparatus according to claim 10, wherein said electric power supplying means controls the electric power supply so as to maintain the detected temperature at a predetermined level.

* * * * *

UNITED STATES PATENT AND TRADEMARK OFFICE

CERTIFICATE OF CORRECTION

PATENT NO. : 6,959,158 B2
DATED : October 25, 2005
INVENTOR(S) : Tomoichirou Ohta It is certified that error appears in the above-identified patent and that said Letters Patent is hereby corrected as shown below:

Column 7,
Line 2, “to the” should read -- the --.

Column 12,
Line 5, “temperature at” should read -- temperature of at --.

Column 13,
Line 21, “temperature at” should read -- temperature of at --.

Signed and Sealed this

Twenty-eighth Day of March, 2006

JON W. DUDAS
*Director of the United States Patent and Trademark Office*